US007686002B2

(12) United States Patent
Andrews

(10) Patent No.: US 7,686,002 B2
(45) Date of Patent: Mar. 30, 2010

(54) TOY PROJECTILE LAUNCHER

(75) Inventor: Michael Andrews, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 5 days.

(21) Appl. No.: 11/853,409

(22) Filed: Sep. 11, 2007

(65) Prior Publication Data

US 2009/0064979 A1 Mar. 12, 2009

(51) Int. Cl.
*F41B 11/00* (2006.01)

(52) U.S. Cl. ..... 124/65; 124/54; 124/55; 124/56; 124/16; 124/78; 124/80; 124/1; 124/3; 446/487

(58) Field of Classification Search ..... 124/54, 124/55, 56, 16, 78, 80, 1, 3; 447/487
See application file for complete search history.

(56) References Cited

U.S. PATENT DOCUMENTS

| | | | | |
|---|---|---|---|---|
| 1,304,857 | A | 5/1919 | Davis | |
| 2,073,436 | A | 5/1937 | Woodhead | |
| 2,247,111 | A | 6/1941 | Batchelor | |
| 3,267,600 | A | 8/1966 | Ryan | |
| 3,401,596 | A | 9/1968 | Hirsch | |
| 4,625,621 | A | 12/1986 | Warin | |
| 4,895,376 | A | 1/1990 | Chiang | |
| 5,233,375 | A | 8/1993 | Williams | |
| 5,653,215 | A * | 8/1997 | Chung et al. | 124/66 |
| 5,944,006 | A * | 8/1999 | Moore et al. | 124/65 |
| 6,257,146 | B1 | 7/2001 | Stonebraker | |
| 6,293,040 | B1 | 9/2001 | Luth | |
| 6,381,894 | B1 | 5/2002 | Murphy | |
| 6,511,201 | B1 * | 1/2003 | Elrod | 362/119 |
| 6,902,483 | B2 | 6/2005 | Lin | |
| 6,959,838 | B2 * | 11/2005 | Eddins et al. | 222/79 |
| 7,108,576 | B2 | 9/2006 | LaPointe | |
| 7,156,085 | B2 * | 1/2007 | Lewis et al. | 124/66 |
| 7,159,584 | B2 | 1/2007 | Maeda | |
| 7,173,540 | B2 | 2/2007 | Daigle | |
| 7,185,787 | B2 * | 3/2007 | Brown et al. | 222/79 |
| 2002/0016127 | A1 * | 2/2002 | Skinner et al. | 446/176 |
| 2005/0016514 | A1 * | 1/2005 | Nadel | 124/56 |
| 2005/0279004 | A1 * | 12/2005 | Woodmansee et al. | 42/146 |
| 2008/0022988 | A1 * | 1/2008 | Rosenblum et al. | 124/27 |
| 2008/0277413 | A1 * | 11/2008 | Jablonski et al. | 222/79 |

* cited by examiner

*Primary Examiner*—Troy Chambers
*Assistant Examiner*—Samir Abdosh
(74) *Attorney, Agent, or Firm*—The Mueller Law Office, P.C.

(57) ABSTRACT

The present invention is a toy launcher which is transfigurable from a compacted state to an operative state for launching projectiles. In one embodiment, the launcher utilizes a hand-pressurized air pump for providing the launching power, and may accommodate multiple types of projectiles to be loaded in the gun at the same time. Projectiles may include, for example, a bolo bullet, grapnel, or miniature missiles. Auxiliary retractable features such as targeting components and a flashlight with a logo projector may be added to enhance the play value of the invention.

19 Claims, 5 Drawing Sheets

TOY PROJECTILE LAUNCHER

BACKGROUND OF THE INVENTION

The field of this invention is toy projectile launchers. While toy launchers have been popular for many years, new and unique ways of firing projectiles continually evolve in order to provide amusement and recreational play for children and adults alike.

In one aspect of providing entertainment features, toy launchers may be transformable from a launcher into another shape. For example, U.S. Pat. No. 3,267,600, entitled "Arrangement of Disguising a Toy Cap Gun," describes a toy gun in which the components may be reconfigured to disguise the gun as an innocuous object such as a radio or camera. In U.S. Pat. No. 4,625,521 entitled "Compact Foldable Gun," a non-toy gun is disclosed in which the magazine housing and stock may be folded for storing and carrying the gun.

Other improvements in toy launchers have occurred by adding unique features. For instance, U.S. Pat. No. 2,097,749, entitled "Toy Machine Gun," sets forth a gun which emits light through a diaphanous member, accompanied by sound to simulate firing of a machine gun. U.S. Pat. No. 7,108,576, entitled "Foam Projectile Exhibiting an Illuminating Element," describes a foam projectile with light emitting diodes which can be emitted from a launcher such as a gun, slingshot, or cannon. In yet another example, U.S. Pat. No. 6,902,483, entitled "Handheld Electronic Game Devices Having the Shape of a Gun," describes an electronic gun in which the triggers are used to play an electronic game which is viewed on a retractable display screen.

While toy projectile launchers have been seen in many forms, novel ways of providing engaging play features and of transforming the device may offer improved amusement value over previous inventions.

SUMMARY OF THE INVENTION

The toy launcher of this invention provides features which encourage imaginative play simulating, for example, secret agents, movie characters, military personnel, or superheroes. The launcher is transformable from compacted state to an operative state for launching projectiles. In one embodiment, the launcher utilizes a hand-pressurized air chamber for providing the launching power, and may accommodate multiple types of projectiles to be loaded in the launcher at the same time. Projectiles may include, for example, a bolo bullet, a grapnel, or miniature missiles. Auxiliary retractable features such as targeting components and a flashlight with a logo projector may be added to enhance the play value of the invention.

DETAILED DESCRIPTION OF THE EMBODIMENTS

Figure 1:
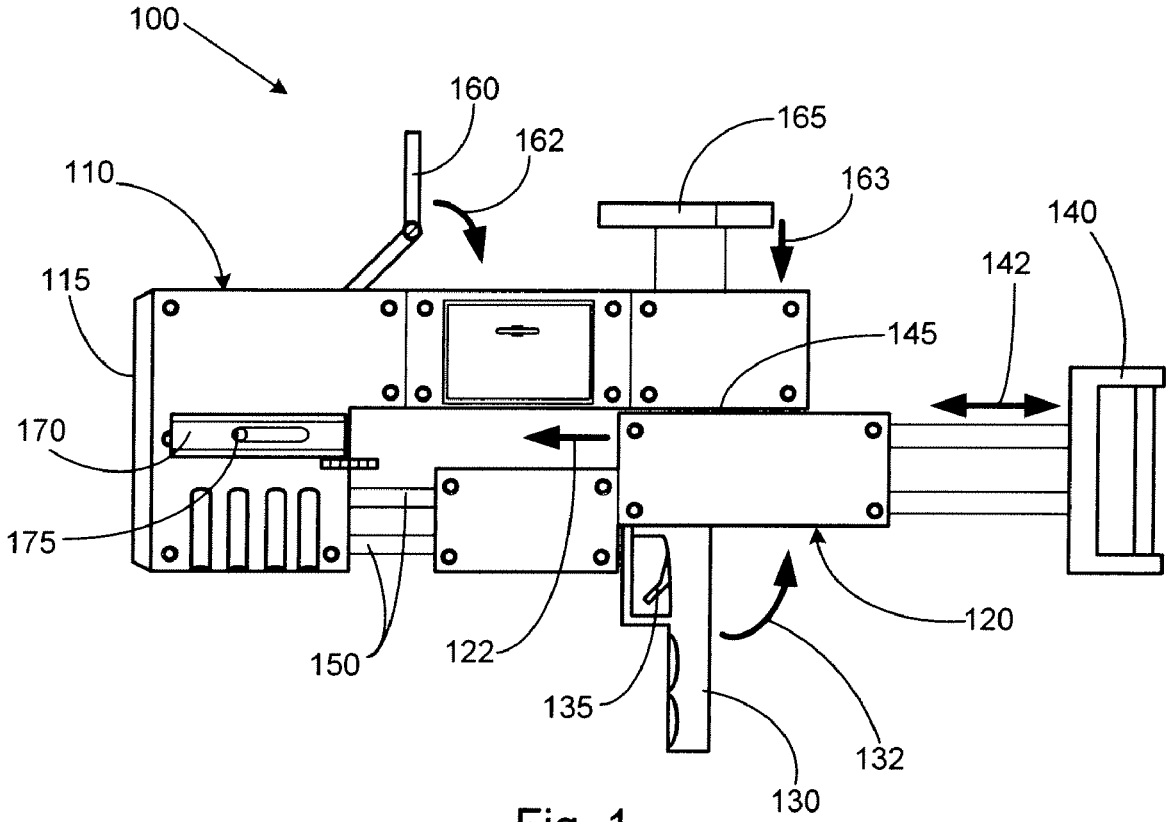
FIG. 1 is a side view of an embodiment of the invention in an open position.

In FIG. 1, an exemplary side view of the projectile launcher 100 is shown in an open and operable position. The primary sections of launcher 100 include upper housing 110 and lower housing 120, as well as gripping handle 130 and pumping handle 140 which are coupled to lower housing 120. Upper housing 110 includes a front face 115 from which projectiles are launched. In this embodiment, the upper housing 110 and lower housing 120 are movably coupled to each other at interface 145 and at the front end of lower housing 120 via one or more alignment bars 150. Interface 145 may incorporate means such as sliding tracks, or a slot with mating tab, to allow the two housings 110 and 120 to move relative to each other, as indicated by the arrow 122, while remaining securely mated. Gripping handle 130 is positioned vertically as shown when the launcher is in firing mode, and may be pivoted toward lower housing 120 as shown by arrow 132 when not being used. Pivoting of gripping handle 130 may be achieved using mechanisms such as a pin joint or a hinge. Pumping handle 140 reciprocates back and forth from lower housing 120 as represented by arrow 142 in order to pressurize an air chamber within lower housing 120. The pressurized air inside the launcher is used to fire projectiles from launcher 100 when trigger 135 is depressed.

FIG. 1 also depicts auxiliary features which may enhance the play value of the launcher. Targeting screen 160 and viewing scope 165 extend from the top of upper housing 110 to aid in sighting of a desired target. Targeting screen folds into upper housing 110 as indicated by arrow 162, while viewing scope 165 retracts into upper housing 110 as indicated by arrow 163. Flashlight 170 is positioned on the side of upper housing 110, and is operated using switch 175. While these auxiliary features will be described later in more detail, it should be noted that these components may be incorporated into the launcher individually or together in any combination.

Figure 2:
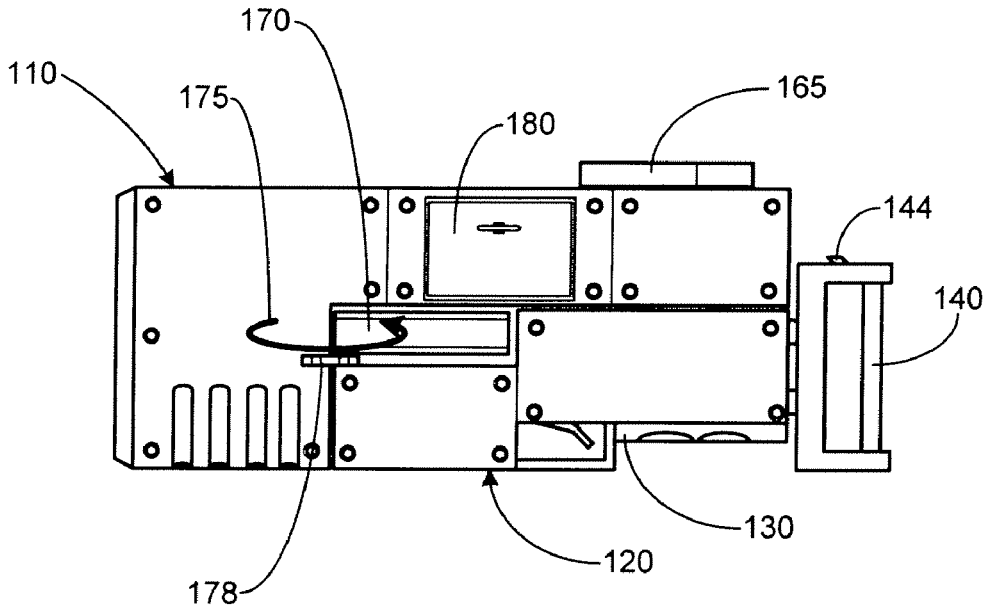
FIG. 2 shows a side view of a projectile launcher in a closed position.

Moving to FIG. 2, the launcher of FIG. 1 is now shown in its closed position. This closed mode may be used for purposes such as storing the toy in a more compact space, or to facilitate carrying the device during play. Such a compacted configuration may be useful for hiding the weapon when approaching a target, or for carrying it around by hand or in a backpack. The closed mode is achieved by sliding upper housing 110 and lower housing 120 together, pivoting gripping handle 130 toward lower housing 120, and retracting enhancement features. For example, the viewing scope 165 may be pushed downward into upper housing 110 using a spring-loaded mount which latches shut, and be released into its extended position with a release switch, not shown. Alternatively, viewing scope 165 may be manually opened and closed with a friction fit, a ratcheting system, or other means known in the art. Flashlight 170 may flip from its forward-facing operative position to its stowed position as indicated by arrow 175, fitting between upper housing 110 and lower housing 120, by pivoting on hinge 178. Other retracting modes are possible for flashlight 170, such as using hinged arm linkages or sliding tracks.

In the embodiment of FIG. 2, the compacted form of the launcher forms a substantially rectangular shape. However, other forms are possible for the overall outline of the closed launcher such as a rounded shape, triangular shape, or the shape of a character logo. Gripping handle 135, targeting screen 160, and viewing scope 165 may vary in shape and position on the launcher to achieve differing forms of the overall compacted launcher. For instance, the viewing scope 165 may take the form of a rounded dome on the top of the launcher, or targeting screen 160 may be positioned on the side of the launcher.

The launcher may include locking components to maintain the device in its compacted or closed form. In one embodiment, a lock 144 may be located on pumping handle 140 to lock the launcher in closed position. When lock 144 is released, upper housing 110 and lower housing 120 are able to move apart. Additionally, flashlight 170 may flip open automatically when lock 144 is released. In other possibilities, latching mechanisms, not shown, may be incorporated into the upper housing 110 or lower housing 120 to lock the launcher in its closed position.

Figure 3:
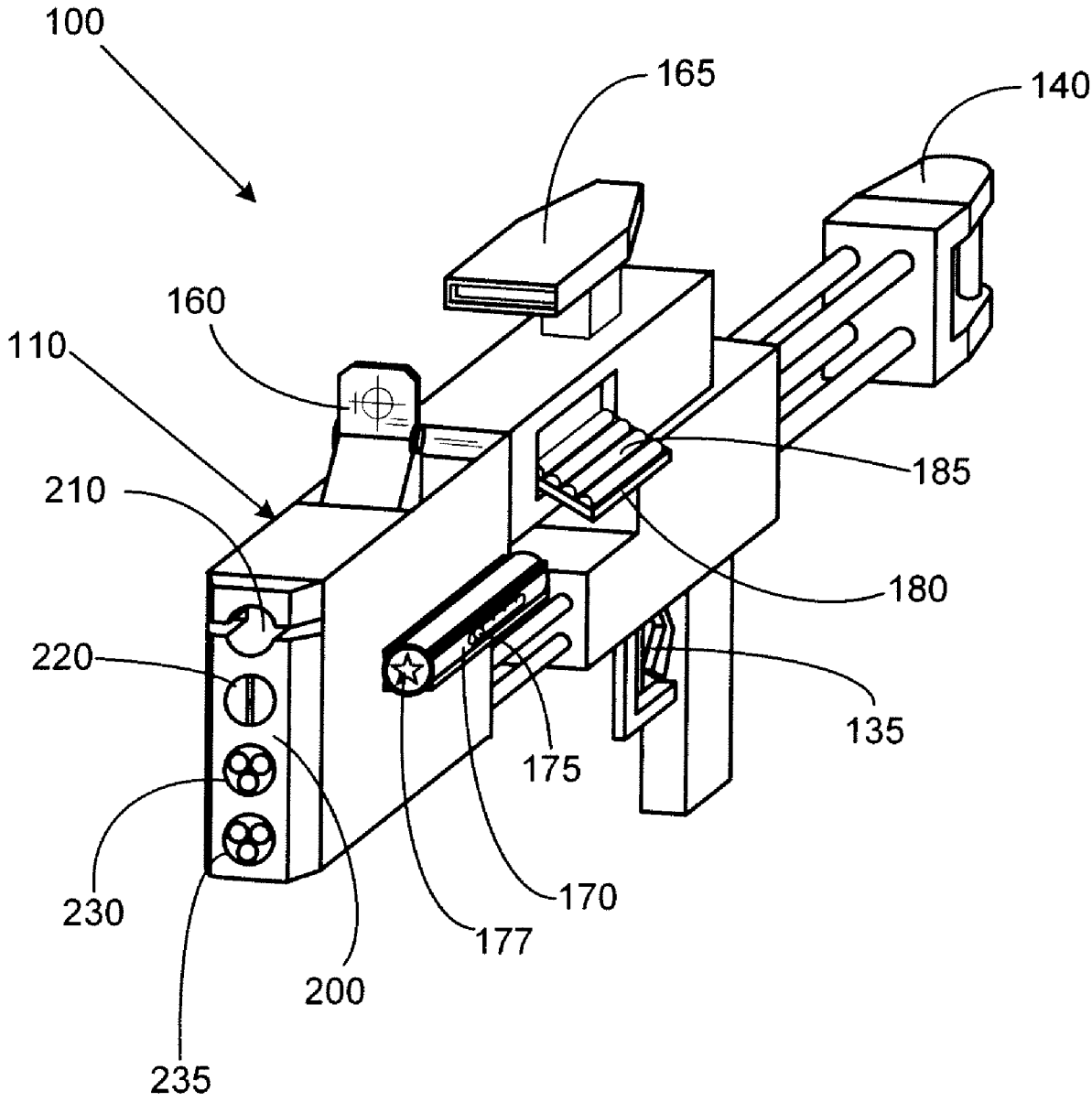
FIG. 3 illustrates a perspective view of an exemplary launcher.

A perspective view of the launcher in its operating position is given in FIG. 3. As described earlier, launcher 100 is equipped with flashlight 170. Flashlight 170 may be used to illuminate the player's view with normal light, with colored light, or to project a logo 177. The user may switch logos or colors using, for example, a multiple-position sliding switch 175 on the side of the flashlight. Targeting screen 160 is seen to fold into the top of launcher 100, and may be incorporated with lighting features. For instance, targeting screen 160 may be illuminated with green light when the launcher's air pressure is sufficient for launching projectiles, and may change to red light when the target has been locked; that is, when the player's finger has slightly depressed the trigger. Viewing scope 165 is shown in this embodiment to be a wide angle lens, although it may take the form of other lenses such as a night vision viewer or a telescoping lens. With both targeting screen 160 and viewing scope 165 located in the same line of sight along the top of launcher 100, the user would choose between using only one of these features at a time.

Figure 4A:
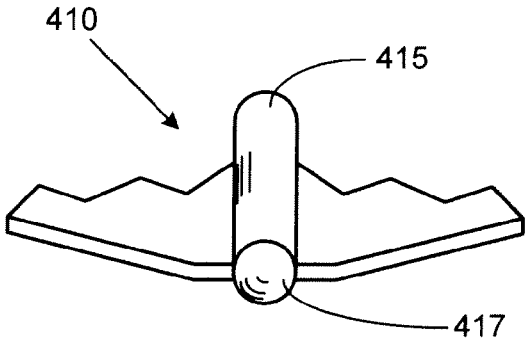
FIGS. 4A, 4B, and 4C depict exemplary projectiles.
Figure 4B:
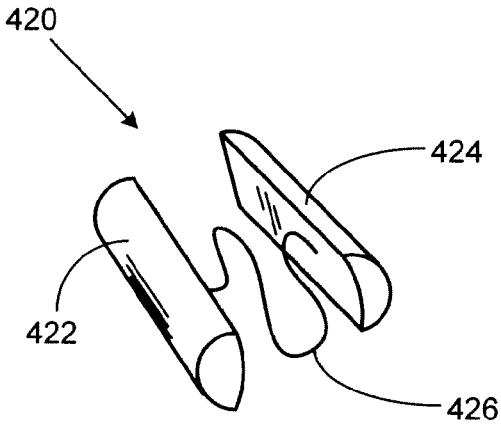
Figure 4C:
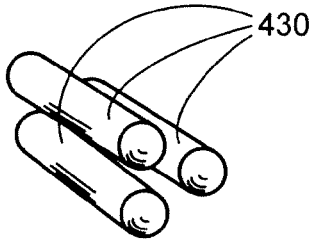

Now considering FIG. 3 and FIG. 4 in combination, the projectile launching face 200 and corresponding projectiles are introduced. The projectile launching face 200 in this embodiment is depicted with recessed spaces, or bores, to accommodate three types of projectiles shown in FIGS. 4A, 4B, and 4C. The projectiles are loaded by sliding them into the preferably cylindrical bores of launching face 200, and are held in place by a friction fit. Bores 210, 220, 230, and 235 may all have substantially the same diameter, or may vary in diameter, depending on the projectile design.

FIG. 4A depicts a grapnel which fits into bore 210 of FIG. 3. Grapnel 410 is a winged dart, which may be weighted on its back end 415 to enable the grapnel 410 to flip over in flight. The bolo bullet 420 of FIG. 4B corresponds to bore 220 of FIG. 3. Bolo bullet 420 is a projectile in which two halves 422 and 424 are connected by a string 426. Upon firing, the two parts 422 and 424 split apart, so that string 426 preferably wraps around the target. Bores 230 and 235 of FIG. 3 are configured to fire the miniature missiles 430 of FIG. 4C, which in this embodiment numbers three but may also be, for example, two or four. Any number of miniature missiles 430 is possible, depending on the size of the missiles 430 and the width of launching face 200 of FIG. 3. The miniature missiles are loaded individually into the sub-spaces of bores 230 and 235, but are launched simultaneously when the trigger 135 is depressed. In an exemplary configuration, the projectiles of FIGS. 4A, 4B, and 4C may be fabricated from foam and may include a polyvinyl chloride (PVC) cap on tip 417 of the projectiles for weight, safety, and durability.

Figure 5A:
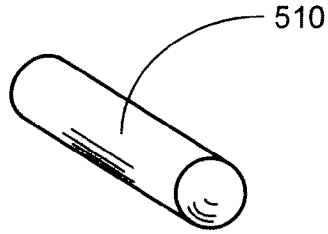
FIGS. 5A, 5B, and 5C demonstrate alternative projectiles.
Figure 5B:
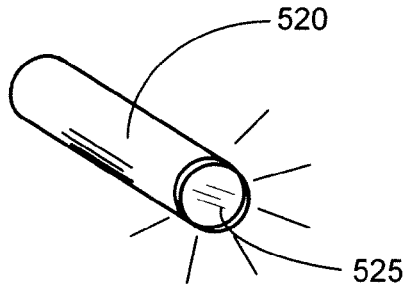
Figure 5C:
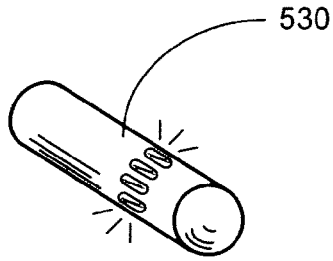

While the launcher 100 of FIG. 3 has been embodied with the projectiles shown in FIG. 4, it should be understood that other projectiles may be used. For instance, a simple cylindrical foam dart 510 of FIG. 5A, a pod 520 such as in FIG. 5B which includes colored or flashing light emitting diodes to be illuminated through face 525, or a projectile 530 which emits sound effects as in FIG. 5C may be used. The launching face 200 of FIG. 3 may comprise a single bore, or more than the four shown in this embodiment. The bores may all be configured for the same type of projectile, or multiple types as shown. Furthermore, one bore may accommodate more than one type of projectile. For example, the lighted pod 520 of FIG. 5B may be shot from grapnel bore 210 of FIG. 3.

An additional feature shown in FIG. 3 is storage compartment 180 for storing spare projectiles. In this illustration, the projectiles 185 which are stocked in storage compartment 180 represent miniature missiles to be utilized with bore 230 or 235. Storage compartment 180 is contained in upper housing 110, and is shown in this embodiment as a hinged door opening vertically downward. Alternatively, storage compartment 180 could be a drawer sliding horizontally outward, or a side-hinged door with built-in clips to hold the projectiles in place. Storage compartment 180 may be incorporated on only one side of launcher or on both sides, for instance to hold a different type of projectile on each side.

To operate the launcher, the user typically begins with the launcher in its compacted form. The user then releases any locking mechanisms that are present to allow the user to slide the upper housing 110 and lower housing 120 apart, and pivots gripping handle 130 into firing position. If not already in place, projectiles are loaded into the firing bores in launching face 200. The user next reciprocates the pumping handle 140 back and forth to pressurize the air chamber within the launcher. When preparing to fire, the player may utilize flashlight 170, viewing scope 165, or targeting screen 160 to sight the desired goal. In one embodiment, targeting screen 160 may include a lighting feature to which changes from one color, such as green for "ready" state, to another color, such as red for "on target" state when the finger is placed on the trigger. To launch a projectile, the user fully depresses the trigger 135.

Figure 6:
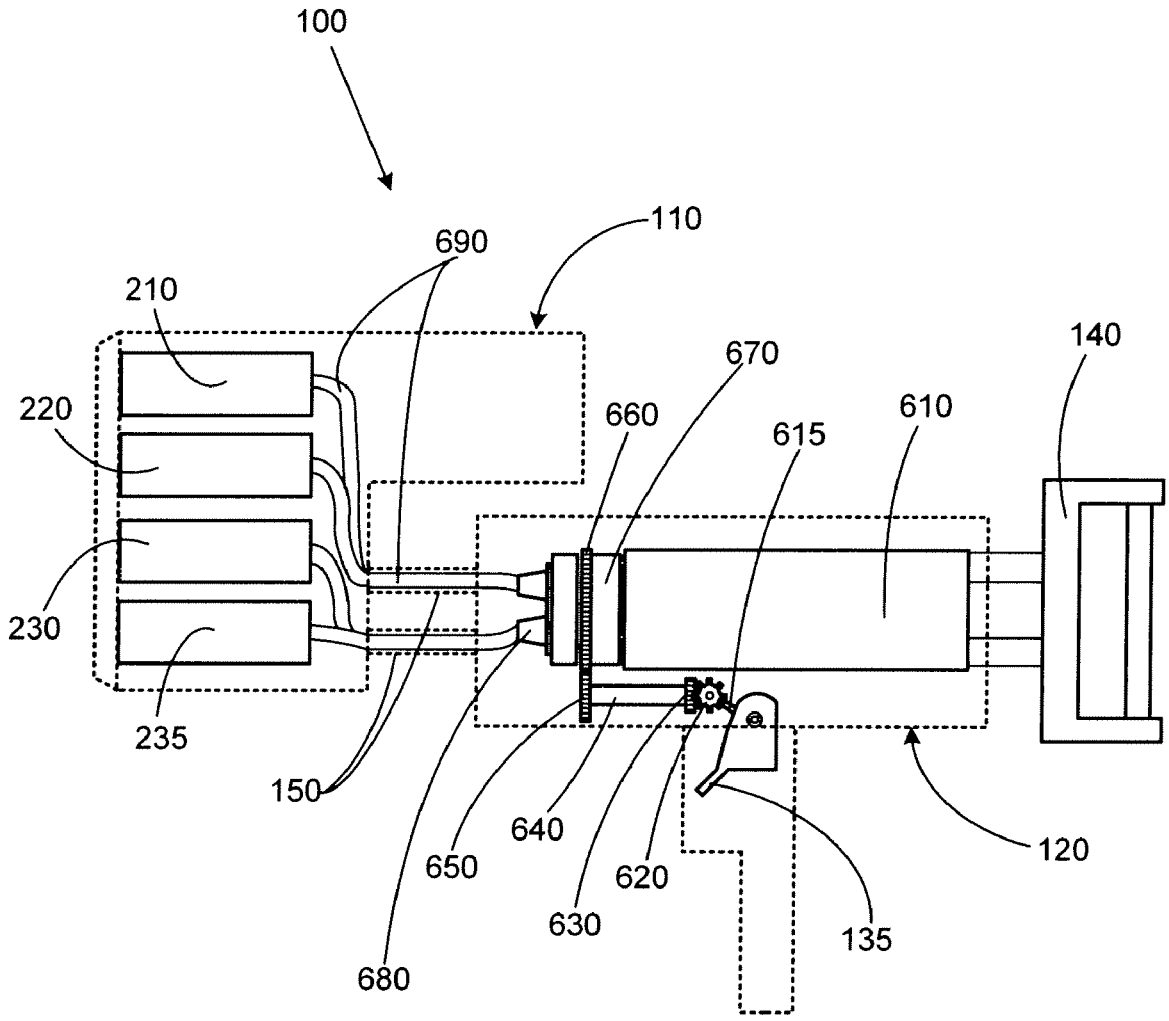
FIG. 6 is a schematic of an exemplary indexing system.

The launcher indexes to the subsequent projectile bore each time the launcher is cocked, thus sequentially firing projectiles out of the launcher. FIG. 6 provides a schematic of the system for indexing the launcher to fire the projectiles. In FIG. 6, bores 210, 220, 230, and 235 are seen to be housed within upper housing 110. Air chamber 610 is located inside lower housing 120, and is pressurized by movement of pumping handle 140. When trigger 135 is depressed, tab 615 is tilted, turning first gear 620. Gear 620 mates with bevel gear 630, which transmits its rotation through shaft 640 to gear 650. Gear 650 then turns gear 660 which is fixed around the outer surface of collar 670. Collar 670 contains an internal aperture, not shown, which serves as an outlet for the air chamber 610. As collar 670 turns, the internal aperture indexes to one of the nozzles 680, allowing pressurized air to proceed through one of the air tubes 690. In the embodiment shown, four nozzles 680 and four air tubes 690 are present, one for each of the four bores 210, 220, 230, and 235. Air tubes 690 travel from nozzles 680 to bores 210, 220, 230, and 235 through alignment bars 150. Upon initial firing, collar 670 may index to allow, for example bore 210 to fire its projectile. Upon the next firing, bore 220 would fire, then bore 230, and finally bore 235. Note that if no projectile is present in a bore, the pressurized air simply ejects out of the open bore.

Figure 7:
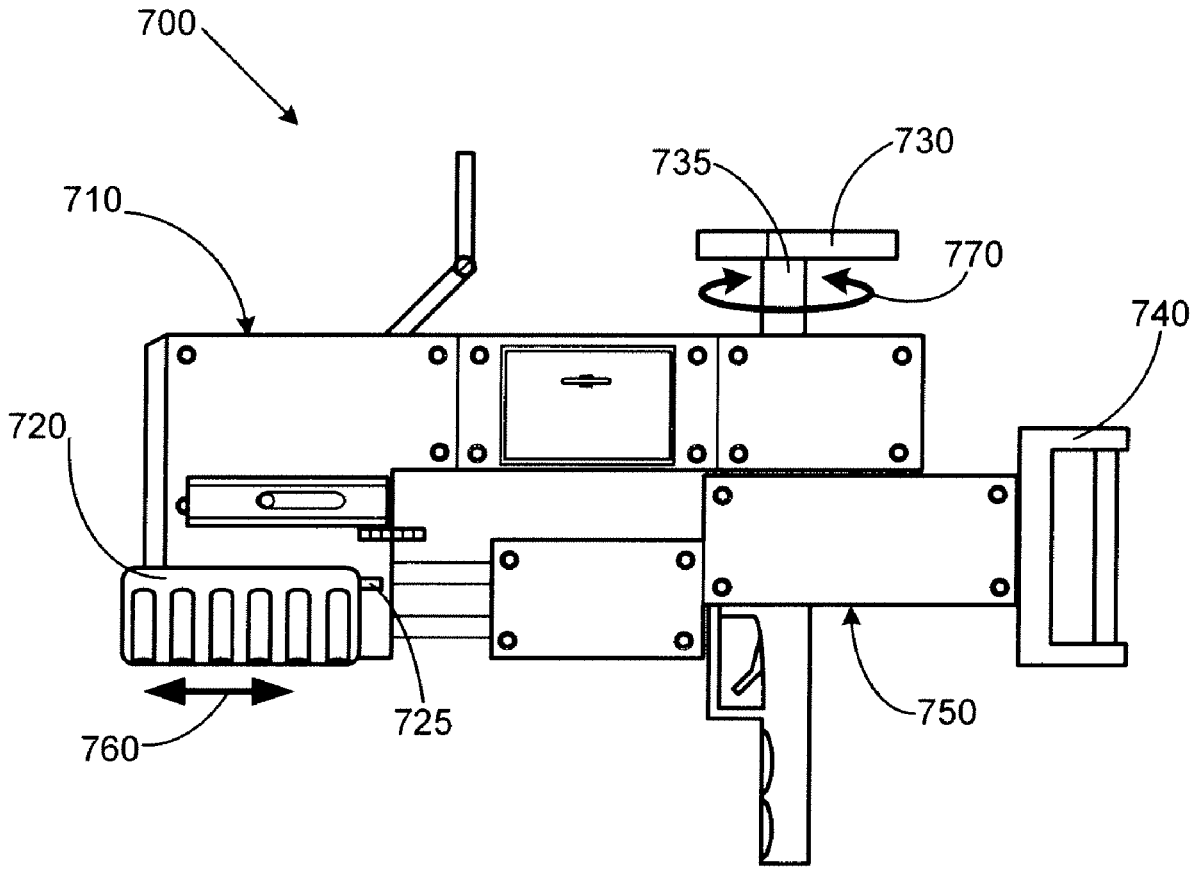
FIG. 7 shows a modified embodiment of a projectile launcher.

A modified embodiment of the invention is depicted in FIG. 7. In this figure, a projectile launcher 700 includes an upper housing 710, a pump handle 720 sliding on a track 725 at the bottom portion of upper housing 710, a viewing scope 730 mounted on a rod 735, and a back handle 740 at the rear of a lower housing 750. The launcher 700 contains an internal air chamber, not shown, which is pressurized when a user reciprocates pump handle 720 back and forth as indicated by arrow 760. The back handle 740 is a stationary handle to help the user hold the launcher 700 during use. Viewing scope 730 may retract into upper housing 710 as previously described with respect to launcher 100. However, the modified viewing scope 730 of launcher 700 may also rotate on rod 735 as shown by arrow 770 to provide the user with a circumferential view of the surroundings.

Although embodiments of the invention have been discussed primarily with respect to specific embodiments thereof, other variations are possible. For example, lighted components may comprise light emitting diodes, incandescent bulbs, or equivalent light sources. Retracting components may achieve movement using hinges, gears, bar linkages, rotating shafts and bushings, sliding joints, universal joints, and the like. While projectiles have been depicted as substantially cylindrical, they may take other forms such as rods with rectangular cross-sections or spherical pellets. Although the launcher has been described using air pressure for firing projectiles, it is possible to use other sources of energy such as springs, elastic bands, or batteries to operate the device. Additionally, the indexing system may vary in the types and numbers of gears present and still yield a functional mechanism.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to limit the invention. Thus, it is intended that the present subject matter covers such modifications and variations as come within the scope of the appended claims and their equivalents.

What is claimed is:

1. A toy projectile launcher, comprising:

an upper housing, wherein said upper housing comprises a bore for loading projectiles, and wherein said upper housing has a first central axis;

a lower housing slidably coupled adjacent to said upper housing, wherein said lower housing is movable from a contracted position to an extended position along a second central axis, wherein said second central axis is offset from said first central axis, and wherein neither the lower housing nor the upper housing is located inside the other housing in the contracted position;

a gripping handle pivotally attached to said lower housing, wherein said gripping handle is movable from a folded position to an unfolded position;

a trigger coupled to said gripping handle;

an air chamber mounted in said lower housing;

a pumping handle extendable from said lower housing, wherein said pumping handle comprises a piston for pressurizing said air chamber;

wherein said toy projectile launcher forms the shape of a gun when said lower housing is in said extended position and when said gripping handle is in said unfolded position; and wherein said toy projectile launcher forms a compacted shape when said lower housing is in said contracted position and said gripping handle is in said folded position.

2. The toy projectile launcher of claim 1, wherein said compacted shape is a rectangular box.

3. The toy projectile launcher of claim 1, further comprising a targeting screen coupled to said upper housing, wherein said targeting screen is movable from a stored position to a viewing position.

4. The toy projectile launcher of claim 3, wherein said targeting screen further comprises a lighting component.

5. The toy projectile launcher of claim 4, wherein said lighting component changes color when said trigger is depressed.

6. The toy projectile launcher of claim 1, further comprising a wide angle lens coupled to said upper housing, wherein said wide angle lens is movable from a retracted position to an deployed position.

7. The toy projectile launcher of claim 1, further comprising a flashlight coupled to said upper housing, wherein said flashlight is movable from a stowed position to an operable position.

8. The toy projectile launcher of claim 7, wherein said flashlight further comprises a logo projector.

9. The toy projectile launcher of claim 7, wherein said flashlight further comprises more than one color of light.

10. A toy projectile launcher, comprising:

an upper housing having a first central axis, wherein said upper housing comprises two bores for loading non-interchangeable projectiles, wherein said two bores are different in shape from each other;

a lower housing slidably coupled adjacent to said upper housing, wherein said lower housing is movable from a contracted position to an extended position along a second central axis, wherein said second central axis is offset from said first central axis, and wherein neither the lower housing nor the upper housing are located inside the other housing in the contracted position;

a gripping handle pivotally attached to said lower housing, wherein said gripping handle is movable from a folded position to an unfolded position;

a trigger coupled to said gripping handle;

wherein said toy projectile launcher forms the shape of a gun when said lower housing is in said extended position and when said gripping handle is in said unfolded position; and wherein said toy projectile launcher forms a compacted shape when said lower housing is in said contracted position and said gripping handle is in said folded position.

11. The toy projectile launcher of claim 10, wherein said two bores are each configured to accept different types of projectiles from each other.

12. The toy projectile launcher of claim 11, wherein said projectiles comprises a foam dart.

13. The toy projectile launcher of claim 10, further comprising a storage compartment enclosed in said upper housing, wherein said storage compartment is configured to store said projectiles, and wherein said storage compartment is movable from a closed position to an open position.

14. The toy projectile launcher of claim 10, further comprising a targeting screen coupled to said upper housing, wherein said targeting screen is movable from a stored position to a viewing position.

15. The toy projectile launcher of claim 10, further comprising a wide angle lens coupled to said upper housing, wherein said wide angle lens is movable from a retracted position to an deployed position.

16. The toy projectile launcher of claim 10, further comprising a flashlight coupled to said upper housing, wherein said flashlight is movable from a stowed position to an operable position.

17. A method for launching a projectile from a toy launcher, wherein said toy launcher has an upper housing, a lower housing slidably coupled adjacent to said upper housing, a pumping handle, an air chamber, a gripping handle, and a trigger, and wherein neither the lower housing nor the upper housing are located inside the other housing in the contracted position, the method comprising:

sliding said upper housing and said lower housing from a contracted position to an extended position, wherein said upper housing is slid along a first central axis which is offset from a second central axis of said lower housing;

moving said gripping handle from a folded position to an unfolded position;

reciprocating said pumping handle at least once to pressurize said air chamber; and pressing said trigger to launch said projectile from said toy launcher.

18. The method for launching a projectile from a toy launcher of claim 17, further comprising pressing said trigger more than once to sequentially launch more than one projectile from said toy launcher.

19. The method for launching a projectile from a toy launcher of claim 18, wherein said upper housing comprises more than one bores, and wherein said bores are different in shape from each other to accept different types of non-interchangeable projectiles.

* * * * *